US008516960B2

(12) United States Patent
Bollettin et al.

(10) Patent No.: US 8,516,960 B2
(45) Date of Patent: Aug. 27, 2013

(54) INK WIPING SYSTEM FOR A PRINTING MACHINE

(75) Inventors: Gaetano Bollettin, Landriano (IT); Volkmar Schwitzky, Würzburg (DE); Björn Kriege, Veitschöchheim (DE)

(73) Assignee: KBA-NotaSys SA, Lausanne (CH)

( * ) Notice: Subject to any disclaimer, the term of this patent is extended or adjusted under 35 U.S.C. 154(b) by 742 days.

(21) Appl. No.: 12/161,802

(22) PCT Filed: Apr. 5, 2007

(86) PCT No.: PCT/IB2007/051221

§ 371 (c)(1),
(2), (4) Date: Nov. 12, 2008

(87) PCT Pub. No.: WO2007/116353

PCT Pub. Date: Oct. 18, 2007

(65) Prior Publication Data

US 2009/0183644 A1 Jul. 23, 2009

(30) Foreign Application Priority Data

Apr. 11, 2006 (EP) ..... 06112508

(51) Int. Cl.
*B41F 35/02* (2006.01)
*B41F 9/10* (2006.01)
*B41F 9/16* (2006.01)

(52) U.S. Cl.
USPC ..... 101/167; 101/425

(58) Field of Classification Search
USPC ..... 101/167, 155, 161, 423, 425
IPC ..... B41F 9/08, 9/16, 35/02
See application file for complete search history.

(56) References Cited

U.S. PATENT DOCUMENTS 3,656,431 A * 4/1972 Giori ..... 101/425
4,236,450 A 12/1980 Bonomi (Continued)

FOREIGN PATENT DOCUMENTS

EP 0 514 756 A1 11/1992
EP 1 055 516 11/2000
FR 1 517 914 3/1968
JP 07-015339 U 3/1995
JP 2000-202984 7/2000

OTHER PUBLICATIONS

International Search Report for PCT/IB2007/051221 mailed Aug. 17, 2007.

(Continued)

*Primary Examiner* — Leslie J Evanisko
(74) *Attorney, Agent, or Firm* — Nixon & Vanderhye P.C.

(57) ABSTRACT

The system comprises a wiping tank (1), a wiping roller (2) rotatably supported in the wiping tank and having a circumferential surface and cleaning means for cleaning the surface of the wiping roller, said cleaning means comprising at least a first spray unit (4) for spraying clean wiping solution against the surface of the wiping roller and a drying blade (12) placed downstream of said first spray unit with respect to a direction of rotation of said wiping roller for removing wiping solution residues from the surface of the wiping roller. The cleaning means further comprise a cleaning assembly including at least one supporting plate (5; 25) with a series of holes (5', 30, 31, 32, 33) and holding means (7, 8, 10, 11) for holding the supporting plate, said supporting plate being conformed to extend parallel to a part of the circumferential surface of the wiping roller without touching said wiping roller. The cleaning assembly further comprising at least a cleaning sheet (6; 26, 26*a*, 26*b*) made of porous material placed on said supporting plate and in contact with the surface of said wiping roller for removing ink therefrom. The first spray unit (4) is disposed before an upstream end of the cleaning assembly with the respect to the direction of rotation of the wiping roller (2) in such a way as to spray clean wiping solution directly between the surface of the wiping roller (2) and the upstream end of the cleaning assembly.

29 Claims, 8 Drawing Sheets

(56) References Cited

U.S. PATENT DOCUMENTS

| | | | | |
|---|---|---|---|---|
| 4,499,825 | A * | 2/1985 | Uno | 101/167 |
| 4,899,654 | A | 2/1990 | Hoshi et al. | |
| 5,390,598 | A | 2/1995 | Stauffer et al. | |
| 5,765,480 | A | 6/1998 | Toyoda | |
| 6,341,556 | B1 * | 1/2002 | Endo | 101/167 |

OTHER PUBLICATIONS

Written Opinion for PCT/IB2007/051221 mailed Aug. 17, 2007.

* cited by examiner

INK WIPING SYSTEM FOR A PRINTING MACHINE

This application is the U.S. national phase of International Application No. PCT/IB2007/051221 filed 5 Apr. 2007 which designated the U.S. and claims priority to European Patent Application No. 06112508.4 filed 11 Apr .2006, the entire contents of each of which are hereby incorporated by reference.

TECHNICAL FIELD

The present invention generally relates to an ink wiping system for use in an intaglio printing machine for printing on sheets or on a continuous web.

BACKGROUND OF THE INVENTION

Such wiping systems are known per se in the prior art. For example, U.S. Pat. No. 4,236,450, the content of which is incorporated by reference in the present application, describes an installation for the continuous cleaning of a wiping roller of an intaglio printing machine. The disclosed installation consists of a wiping system comprising a tank onto which the wiping roller is rotatably mounted, this tank enclosing various cleaning members in contact with the periphery of the wiping roller for cleaning the surface of the wiping roller under the action of a cleaning liquid (commonly designated as "wiping solution"). The cleaning members comprise several brushes and scraper blades which are distributed at regular intervals along the periphery of the wiping roller. More specifically, the wiping system comprises, at an upstream location with respect to the direction of rotation of the wiping roller, a first row of spray nozzles extending parallel to the axis of the wiping roller for spraying wiping solution against the surface of the wiping roller and a first scraper blade which removes approximately 95% of the mass of ink adhering to the surface of the wiping roller. Downstream of the first row of spray nozzles and of the first scraper blade, there is arranged a series of rows of spray nozzles distributed along the periphery of the wiping roller, these rows of nozzles being each combined with brushes. Lastly, another scraper blade (which is commonly designated as "drying blade") is disposed in contact with the surface of the wiping roller and makes it possible to eliminate wiping solution residues remaining on the surface of the wiping roller. An additional row of spray nozzles can be mounted behind the first scraper blade so as to prevent ink particles from accumulating behind this scraper blade. The spray nozzles are connected to the outlet of a pump which supplies them with clean wiping solution. The scraper blades, spray nozzles and brushes are mechanically supported in the tank, the position thereof being adjustable. More specifically, the position of the first scraper blade can be adjusted by means of a hydraulic-actuated control arm enabling the first scraper blade to be retracted away from the surface of the wiping roller or to adjust its pressure against the wiping roller. On the other hand, the brushes and associated rows of spray nozzles are mounted on a common pair of curved rails which are guided in the tank between guide rollers, so that the whole brushes-spray-nozzles assembly can rotate concentrically with the axis of rotation of the wiping roller.

Another ink wiping device for intaglio rotary printing machines is known from U.S. Pat. No. 4,499,825, the content of which is incorporated by reference in the present application. The disclosed system comprises a tank containing wiping solution in which is immersed the wiping roller as well as a cleaning assembly for cleaning the circumferential surface of the wiping roller. The cleaning assembly includes, along the direction of rotation of the wiping roller, at least one brush unit adjustably supported in the tank and having a plurality of rows of bristles having distal ends located in the vicinity of the circumferential surface of the wiping roller. In addition, each brush unit includes a cleaning sheet made of synthetic-fibered non-woven cloth supported on the brush unit and interposed between the circumferential surface of the wiping roller and the distal ends of the bristles. Accordingly, ink that has been removed and transferred from the printing plate to the ink wiping roller is wiped off the latter by the cleaning sheet pressed against the ink wiping roller under the resiliency of the bristles and is dissolved in the cleaning solution. Since the roller and the cleaning assembly (i.e. brush units) are immersed in the cleaning solution, it is necessary to use a drying blade (made of hard rubber as indicated in this patent) for scraping off the cleaning liquid from the ink wiping roller. Below this drying blade, that is upstream of the blade with respect to the direction of rotation of the wiping roller, there is an additional pad of synthetic fibered non-woven cloth supported on a holder above the surface of the wiping solution for blocking off the wiping solution which tends to be carried by the wiping roller as it rotates. The design taught by this patent is disadvantageous in that the cleaning assembly and the wiping roller are immersed in the wiping solution, which thus requires a substantial amount of wiping solution inside the tank. Further, since the wiping roller is partly immersed in the wiping solution; the cleaning efficiency of such a cleaning installation tends to be rather low because the wiping roller is always in contact with wiping solution that is contaminated with ink components. As a matter of fact, the cleaning efficiency is directly dependent on the efficiency of the non-immersed cleaning pad to clean the surface of the wiping roller.

Another system is disclosed in the European Patent application published under the number EP 0 514 756, the content of which is incorporated by reference in the present application. This application teaches a wiping apparatus for an intaglio printing press comprising a cleaning assembly including a series of cleaning members each consisting of a base arranged parallel to the axis of rotation of the wiping roller which carries an arched sheet pad made of a strip of carbon tool steel, said sheet pad having a multitude of tiny openings for scraping ink and being in elastic contact with the peripheral surface of the wiping roller. In addition, a brush unit is further provided downstream of the arched cleaning members, bristles of the brush unit being in elastic contact with the surface of the wiping roller. Accordingly, the ink transferred by the wiping operation from the intaglio printing plates to the wiping roller is scraped through said multitude of tiny openings made in the sheet pads and is dissolved in the cleaning solution, the surface of the wiping roller being lastly cleaned by the brush unit. According to this prior art solution, the lower part of the wiping roller can be immersed in the wiping solution, together with the cleaning members (in a way similar to the solution of U.S. Pat. No. 4,499,825 mentioned above) or wiping solution can be sprayed against the surface of the wiping roller (in a way similar to the solution of U.S. Pat. No. 4,236,450 mentioned above). A major disadvantage of the solution taught in EP 0 514 756 resides in the fact that the surface of the wiping roller is in direct contact with the highly resistant arched sheet pads made of carbon tool steel. As compared to the other solutions using either brushes or soft cleaning sheets/pads, this causes extensive wear of the comparatively softer surface of the wiping roller (which wiping roller is typically coated with a polymer compound such as PVC) which in turn degrades the cleaning efficiency of the wiping apparatus and requires frequent renewal of the wiping roller's coating. In the worst case, the contact of the wiping roller with such highly resistant material can even cause considerable damage to the wiping roller's outer surface.

Japanese utility model 07-015339 U, the content of which is incorporated by reference in the present application, discloses a wiping equipment which wipes off the excess of ink of a wiping roller in an intaglio printing machine which follows a similar route as that taught in EP 0 514 756. The difference resides in that, according to JP 07-015339 U, a large cleaning sheet of carbon tool steel is used in lieu of the various arched cleaning members, the cleaning sheet being in contact with the surface of the wiping roller over a substantially greater portion. As with the solution of EP 0 514 756, the cleaning sheet comprises a multitude of tiny openings to remove the ink present on the surface of the roller. A major drawback of this solution again resides in the fact that the cleaning sheet is made of hard material and is in direct contact with the surface of the wiping roller, which solution leads to the above-described problems. This drawback is even more pronounced in this latter case as the contact surface between the wiping roller and the carbon tool steel cleaning sheet is substantially larger than in the solution disclosed in EP 0 514 756.

U.S. Pat. No. 6,341,556, the content of which is incorporated by reference in the present application, discloses another wiping device of an intaglio printing press which uses a wiping roll cleaning sheet mounted on a base member. The wiping roll cleaning sheet is formed of three superimposed sheets each having through holes, namely a supporting sheet supported by the base member, a cleaning sheet in contact with the circumferential surface of the roller, and a pressing sheet interposed between the cleaning sheet and the supporting sheet for pressing the cleaning sheet against the surface of the wiping roller. As described, the supporting sheet and the cleaning sheets are both preferably constructed as wire nets made of stainless steel, while the pressing sheet is made of an unwoven fabric of synthetic resin (such as nylon). In a specific embodiment, the cleaning sheet can be made of a plate of steel instead of a wire net, said plate having many small holes formed therein and being similar to the plates known from Japanese utility model JP 07-015339 U cited above. The disclosed wiping device further includes, disposed downstream of the above-mentioned wiping roll cleaning sheet with respect to the direction of rotation of the wiping roller, a second wiping unit comprising a cleaning sheet made of an unwoven fabric (for example of synthetic resin) which is supported on top of a number of brushes as taught for example in U.S. Pat. No. 4,499,825 cited hereinabove. Accordingly, in this prior art, the teaching is to use a metallic plate or wire net in direct contact with the wiping roller to remove the ink and wiping solution in addition to a fabric sheet mounted over brushes.

Other similar systems are in addition known from U.S. Pat. Nos. 5,765,480 and 4,899,654, both related to wiping devices for intaglio printing machines.

Another solution is disclosed in Japanese patent application No. JP 2000-202984. This document describes an ink wiping system comprising a first cleaning member for applying clean wiping solution in a laminar stream state against the surface of the wiping roller and a downstream-located cleaning assembly comprising a perforated metallic supporting member conforming to a part of the circumferential surface of the wiping roller, which supporting member supports a porous cleaning sheet contacting the surface of the wiping roller. This cleaning assembly further comprises its own spray means in the form of spraying nozzles which spray wiping solution against the surface of the wiping roller through the supporting member and the cleaning sheet. One disadvantage of this solution resides in the fact that the cleaning efficiency of the first cleaning member is limited because most of the wiping solution applied by this first cleaning member will fall back in the wiping tank and will not be appropriately exploited. As a consequence, the downstream-located cleaning assembly has to be provided with its own spraying means for spraying wiping solution against the surface of the wiping roller. In addition, the efficiency of this latter cleaning assembly is also limited as the sprayed wiping solution first has to penetrate through the cleaning sheet before reaching the surface of the wiping roller. An improved solution is thus still required.

A problem encountered in the known installations spraying wiping solution is the fact that the nozzles, which have a small diameter, may be blocked or obturated by particles present in the cleaning solution so that the cleaning effect is reduced. In such case, it becomes necessary to stop the printing machine, remove the wiping roller to gain access to the shafts with the nozzles and to remove said shafts from the machine to be able to clean the nozzles in a remote place. Once this has been done, the shafts must be assembled and adjusted in the machine and then only can the wiping roller be brought back in position.

The same drawback is present in the systems using plates with a multitude of tiny holes such as described above. The holes may be blocked or obturated by particles hence reducing the efficiency of the plate, this problem being even worse in immersed systems. As mentioned here above, it is then necessary to stop the printing machine and carry out cleaning operations.

The same problem also arises with the solution of JP 2000-202984 where the cleaning assembly is provided with nozzles that will also have a tendency to be blocked by particles.

All these operations are time consuming and, since the machine is not working anymore, they have an important cost.

SUMMARY OF THE INVENTION

An aim of the invention is to improve the known devices and methods. It is a further aim of the present invention to provide a wiping system that is simple, efficient and cheap to produce.

Another aim of the present invention is to provide a wiping system that is easy to install.

Still another aim of the present invention is to provide a wiping system which needs less wiping solution.

These aims are achieved thanks to the apparatus defined in the claims.

According to the invention, the wiping system comprises cleaning means with a cleaning assembly which includes at least a supporting plate with holes and an cleaning sheet of porous material combined with a spraying unit disposed before an upstream end of the cleaning assembly with the respect to the direction of rotation of the wiping roller in such a way as to spray clean wiping solution directly between the surface of the wiping roller and the upstream end of the cleaning assembly.

In another embodiment, the cleaning sheet is separated in at least two parts, allowing a spray unit to spray wiping solution between the two parts.

In a further embodiment, one uses brushes in addition to the cleaning sheet.

The result is an efficient system in which a sheet is applied in a improved and constant manner against the wiping roller, rather than by a soft media such as bristles of brushes. The system also avoids the contact of a metallic plate or wire mesh with the wiping roller avoiding by way of consequence the risk of damaging the surface of the roller in case of an unwanted contact.

Advantageous embodiments of the invention are the subject-matter of the dependent claims.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

EMBODIMENTS OF THE INVENTION

Figure 1:
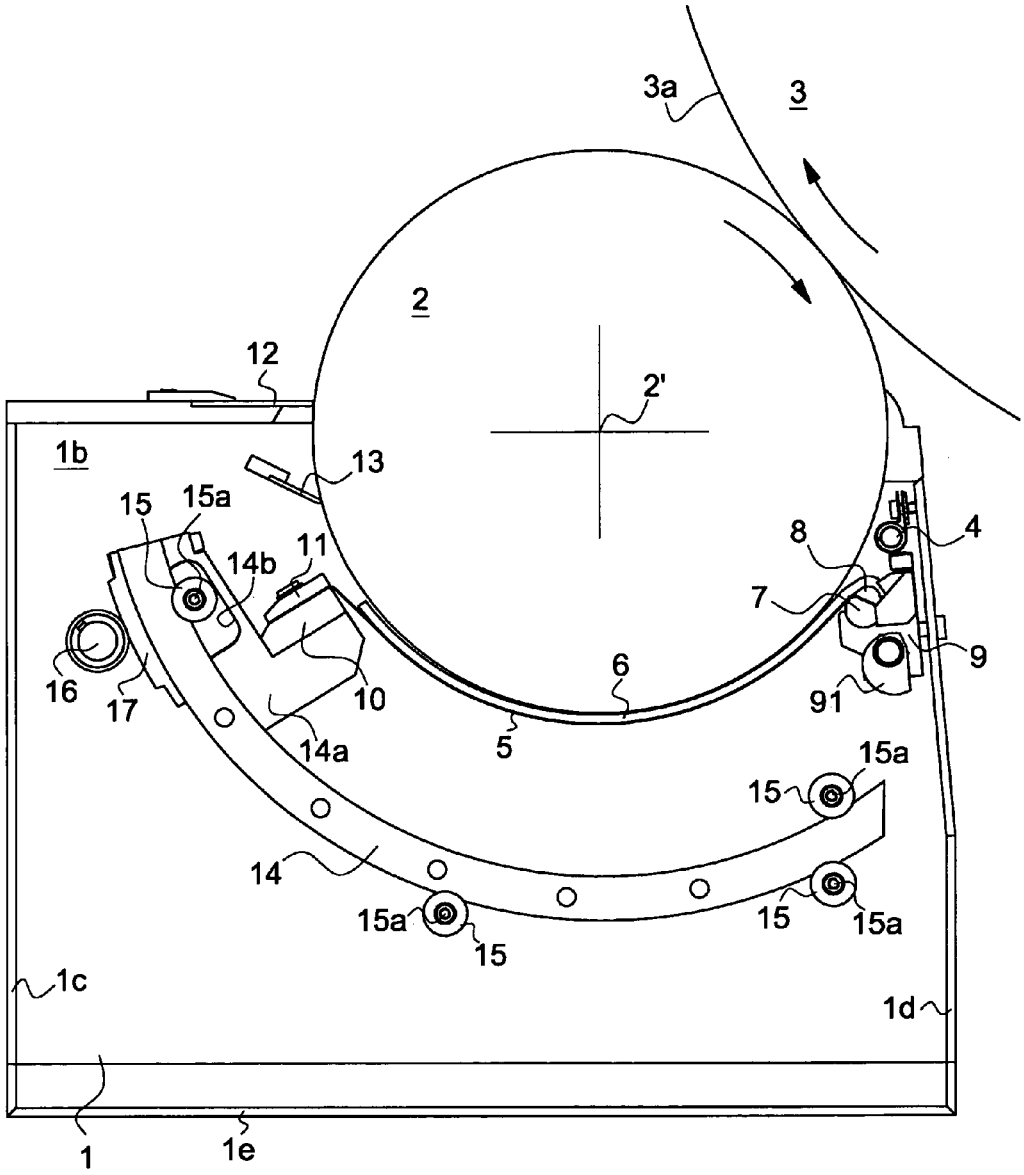
FIG. 1 illustrates a side view of an ink wiping system according to a first embodiment of the invention.

FIG. 1 shows a first side view of the wiping system according to the invention. As is known in the art of printing (for example from U.S. Pat. No. 4,236,450), a wiping roller 2 is rotatably supported about an axis of rotation 2' in a tank 1 and has a circumferential surface positioned for rolling contact with at least one printing plate 3*a* carried by a plate cylinder 3 of the intaglio printing machine. Accordingly, the system comprises the wiping tank 1 placed underneath the wiping roller 2 which comprises-side walls 1*a* to 1*d* and a bottom wall 1*e* for recuperating the wiping solution that has been sprayed by at least a first spray unit 4 against the surface of the wiping roller 2. In order to efficiently remove the ink and the sprayed wiping solution present on the surface of the roller 2, the wiping system additionally comprises a cleaning assembly disposed after the first spray unit 4 with at least a supporting plate 5, preferably made of metal such as stainless steel, and a cleaning sheet 6. The supporting plate 5 has a series of holes 5' (shown in FIGS. 2 and 3), said holes 5' being arranged in an array of rows and columns, and is held by holding means described in more detail hereunder. The supporting plate 5 is conformed to extend parallel to a part of the circumferential surface of the wiping roller 2 without touching said wiping roller surface. The cleaning sheet 6 made of porous material, is placed on the supporting plate 5 and is in contact with the surface of said wiping roller 2 for removing ink therefrom.

Preferably, the cleaning sheet 6 is a material made of porous non-woven synthetic material, for example as commercialised under the tradename "SCOTCH BRITE" ® D by Company 3M or mentioned in U.S. Pat. No. 5,390,598.

The cleaning sheet 6 has a thickness ranging from a couple of millimeters to a couple tenths of millimeters, preferably between 5 and 20 mm. Preferably, the cleaning sheet 6 contacts the surface of the wiping roller 2 over a sector of at least 70°.

The first spray unit 4 is preferably made of a perforated hose attached to side wall 1*d* of the tank 1 extending substantially parallel to the axis of rotation 2' of the wiping roller 2 and having spraying apertures exhibiting a diameter of approximately one square millimeters or more. Within the scope of the present invention, it will be appreciated that the first spray unit 4 is disposed before an upstream end of the cleaning assembly (preferably immediately before the upstream end of the cleaning assembly) with respect to the direction of rotation of the wiping roller 2 indicated by the arrow in FIG. 1 such that clean wiping solution is efficiently sprayed directly between the surface of the wiping roller 2 and the upstream end of the cleaning assembly. One therefore avoids that dean wiping solution falls back into the tank 1 directly after spraying thereof (as in the case of the solution described in Japanese patent publication No. JP 2000-202984) and ensures that this clean wiping solution is used in an efficient manner for the purpose of cleaning the surface of the wiping roller 2.

The supporting plate 5 and the cleaning sheet 6 are both fixed at the upstream end of the cleaning assembly to the tank 1 through holding means. These holding means include a clamping bar system comprising a lower bar 7 and an upper bar 8 preferably screwed together in order to hold the upstream end of the supporting plate 5, and a further clamping mechanism 9 for clamping the cleaning sheet 6 against the upper bar 8 (see FIGS. 8*a* and 8*b* and discussion hereunder). This mechanism is arranged to allow the release of the cleaning sheet 6 and the exchange thereof without freeing the supporting plate 5 which is maintained in clamped position between bars 7 and 8 during this operation.

On the downstream end of the cleaning assembly with respect to the direction of rotation of the wiping roller 2, the supporting plate 5 is maintained in another clamping assembly comprising a base member 10 and a cover member 11, preferably fixed together through screws, between which the downstream end of the supporting plate 5 is clamped. The cleaning sheet 6 is not clamped at this end.

Further downstream with respect to the direction of rotation of the wiping roller 2, at least one scraping blade 12 (or drying blade) is arranged perpendicular to the surface of the wiping roller 2 for removing residual wiping solution and any ink residues still present on the surface of the roller 2. In the embodiment represented on FIG. 1, an optional second blade 13 is represented which can be used to carry out additional scraping of the surface of the roller 2 prior to the drying blade 12. This second blade 13 can the roller 2 prior to the drying blade 12. This second blade 13 can advantageously be made of or coated with a synthetic material, preferably made of plastic or coated with Teflon®. These blades can be mounted on an adjustable mechanism as described in U.S. Pat Nos. 5,765,480 or 4,899,654 for example.

The clamping assembly with the base member 10 and the cover member 11 are mounted on a movable support comprising a pair of curved rails 14 (one on each side wall 1*a*, 1*b* of the tank 1) which are guided by several guide rollers 15. Reference numerals 15*a* denote the axes of the guide rollers 15. One of the curved rails 14 (in this example the curved rail 14 mounted on side wall 1*b*) is driven by a toothed wheel 16 meshing with a corresponding rack 17 attached to that curved rail 14. This disposition and cooperation of the wheel 16 with the rack 17 allow an arcuate displacement of the rails 14 between the rollers 15 and thus allow a precise positioning of the supporting plate 5 with respect to the wiping roller 2. More specifically, this construction allows one to adjust the pressure with which the cleaning sheet 6 is applied against the surface of the wiping, roller 2. This construction also allows an easy adjustment of the cleaning system to the size (diameter) of the wiping roller.

As shown in FIG. 1 (see also FIGS. 2 and 3), the base member 10 is mounted on a support member 14*a* which is secured to each curved rail 14. This support, member 14*a* is advantageously provided with an opening 14*b* dimensioned so as to enclose one of the guide rollers 15 between the support member 14*a* and the curved rail 14. This opening 14*b* ensures that the angular displacement of the cleaning assembly is limited.

If the printing machine in use on a given production site has a wiping system similar to the one disclosed in U.S. Pat. No. 4,236,450, the construction disclosed above advantageously permits an easy retrofit of the cleaning means according to the present invention. Indeed, the present construction uses means (curved rails, guide rollers, toothed wheel, rack) which are all present in the machine according to U.S. Pat. No. 4,236,450.

Figure 2:
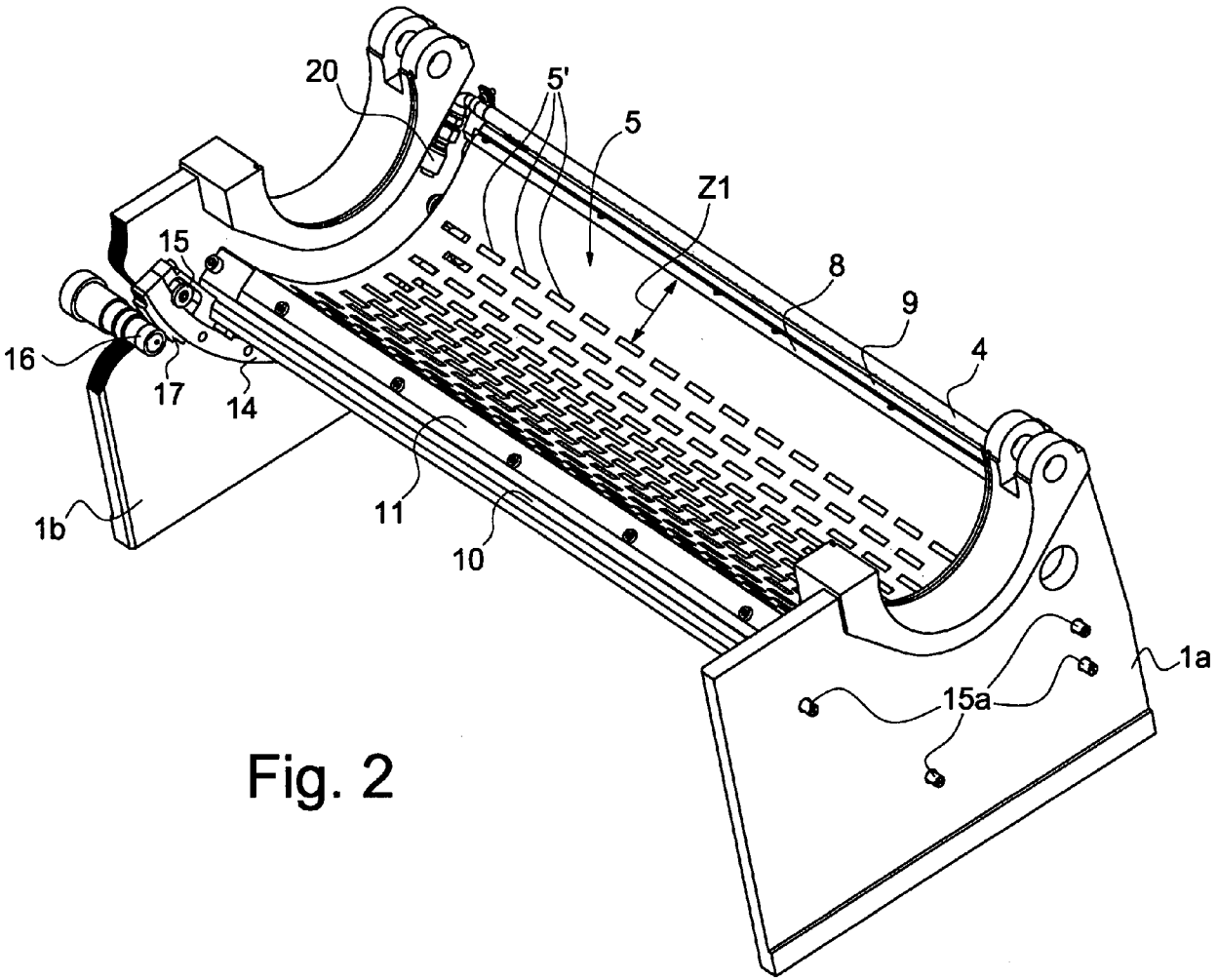
FIG. 2 illustrates a first perspective view of the first embodiment.

In FIG. 2, a perspective view of the first embodiment is represented, in which the elements described with reference to FIG. 1 are identified by the same numerical references. Only part of the tank 1 is shown in FIG. 2, i.e. side walls 1*a* and 1*b* which are located at each extremity of the cleaning assembly. As mentioned, the supporting plate 5 comprises a series of holes 5' arranged in an array. The holes 5' have a substantially rectangular shape in this example (the greater length of which is oriented perpendicularly to the direction of rotation of the wiping roller 2) but other shapes are possible. Also represented in this figure is the adjustment mechanism comprising the rails 14, rollers 15, toothed wheel 16 and rack 17. Only one curved rail 14 can be seen in FIG. 2, the other one being hidden behind sidewall 1*a*.

The supporting plate 5 preferably comprises a first zone Z1 located on the upstream side thereof with respect to the direction of rotation of the wiping roller (see arrow in FIG. 1), which first zone Z1 is free of holes 5'. This allows the cleaning efficiency of the system to be increased in that the sprayed wiping solution is maintained in a volume defined by the upper surface of the supporting plate 5 and the surface of the wiping roller 2 (not shown in FIG. 2), wiping solution being only allowed to flow back into the tank 1 when it reaches the first row of holes 5'.

On side wall 1*a* of the tank 1, one has represented the respective axes 15*a* of the guide rollers 15 guiding the second curved rail. Next to side wall 1*b* there is shown a connecting hose 20 coupled to one extremity of the perforated spraying hose 4. A similar connecting hose (not shown) is also provided at the other extremity of the perforated hose 4, next to side wall 1*a*.

Figure 3:
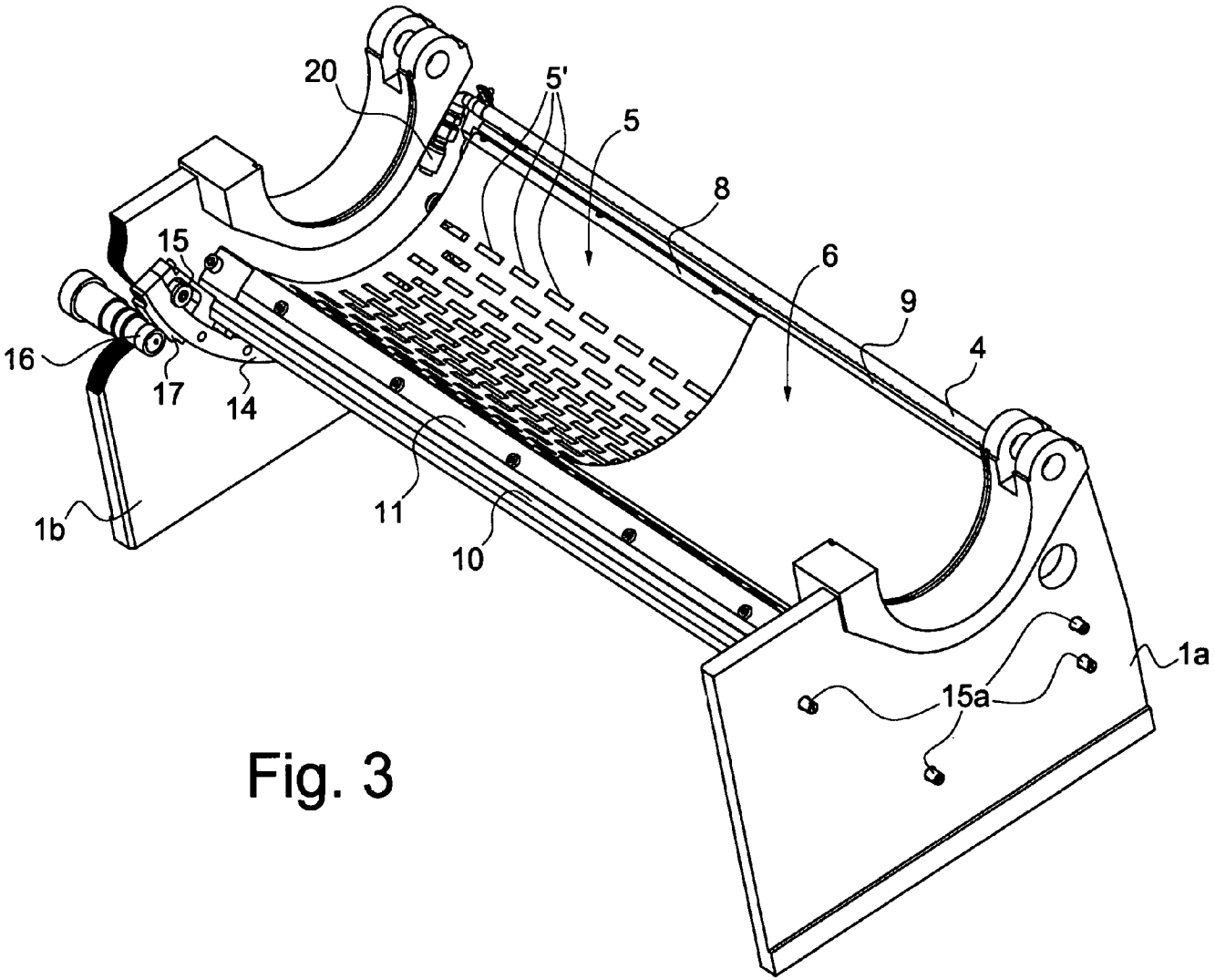
FIG. 3 illustrates a second perspective view of the first embodiment.

In FIG. 3, a second perspective view of the first embodiment is represented. In this view, corresponding elements are identified with the same numerical references and the description made above for FIGS. 1 and 2 applies to this figure. The additional element that has been represented in FIG. 3 with respect to figure is the cleaning sheet 6, only half of which is illustrated. It will of course be understood that the cleaning sheet 6 extends over the entire width of plate 5. As shown in FIG. 1, the cleaning sheet 6 is clamped between upper bar 8 and clamping mechanism 9, the lower bar 7 shown in FIG. 1 being not visible in FIGS. 2 and 3.

Figure 4:
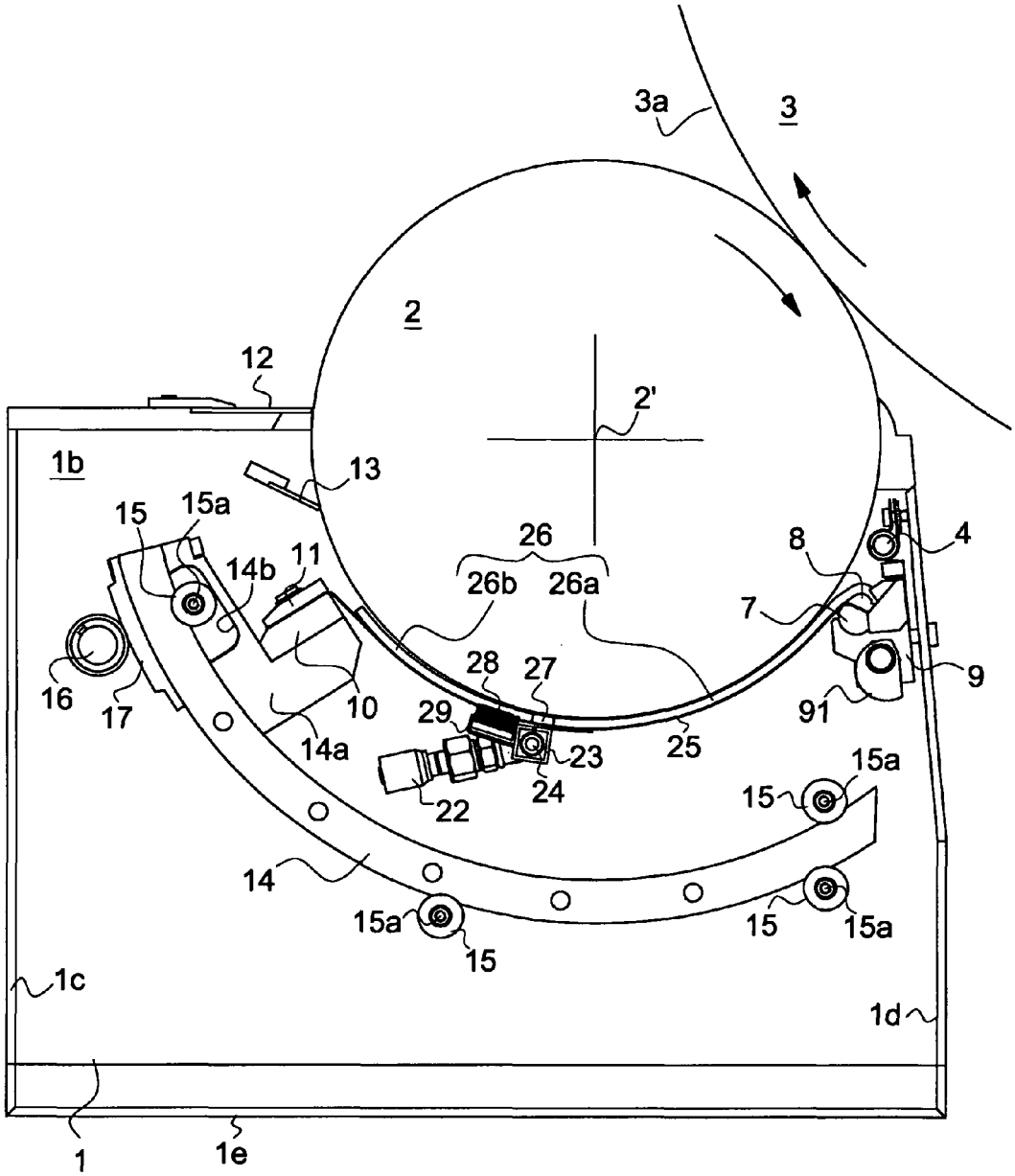
FIG. 4 illustrates a side view of a second embodiment of the invention.

In FIG. 4, a side view of a second embodiment of the invention is illustrated. In this second embodiment, elements which are common with those of the first embodiment are identified with the same reference numerals and the description made above applies correspondingly.

This embodiment comprises a second spraying unit 24 with its connecting hose 22 for the supply of clean wiping solution, which second spray unit 24 is preferably mounted in a rail 23 attached to the supporting plate which is designated in this second embodiment by reference numeral 25. The cleaning sheet 26 is preferably divided into two separate portions 26*a* and 26*b*. The first portion 26*a* of the cleaning sheet 26 is placed in first position with respect to the direction of rotation of the wiping roller 2 (as indicated by the arrow) and the upstream end of this portion 26*a* is held by the same holding means that were described in connection with the first embodiment of FIGS. 1 to 3, i.e. between the upper clamping bar 8 and the clamping mechanism 9. The supporting plate 25 is still clamped at its upstream end between the lower clamping bar 7 and the upper clamping bar 8.

The second portion 26*b* of the cleaning sheet 26 is placed downstream of the first portion 26*a* with respect to the direction of rotation of the wiping roller 2. This second portion 26*b* does not necessarily have to be attached to the plate 25 in a fixed manner. Indeed, this second portion 26*b* can be held in place through the combination of the pressure exerted between the perforated plate 25 and the surface of the wiping roller 2. It has been observed that pressure combined with the presence of the holes in the supporting plate 25 was sufficient to ensure that the second portion 26*b* is properly held in place during the wiping operation.

Since the cleaning sheet 26 is separated in two portions 26*a* and 26*b*, there subsists in this second embodiment a free zone 27 between portions 26*a* and 26*b*. This free zone 27 is preferably designed to enable additional spraying of dean wiping solution against the surface of the wiping roller 2 at a second place by means of the second spraying unit 24. To this end, a row of spray holes (31 in FIGS. 5, 6 and 7) is provided into the supporting plate 25. As compared to the first embodiment, the cleaning efficiency of the wiping system is further improved. The second spraying unit 24 comprises similarly to the first unit 4 a perforated hose extending substantially parallel to the axis of rotation 2' of the wiping roller 2 and having spraying apertures (visible on FIG. 7) exhibiting a diameter of approximately one square millimeters or more which are directed in such a way to spray the wiping solution through spray holes 31 in the free zone 27 and against the surface of the wiping roller 2.

Alternatively, the cleaning sheet could be made in one piece as in the first embodiment and the second spraying unit 24 could spray clean wiping solution through the cleaning sheet.

Both spraying units 4 and 24 can be fed through connecting hoses 20 and 22 with the same source of clean wiping solution, or with separate supply sources.

Preferably, in the second embodiment of FIG. 4, a set of brushes 28 is used. These brushes 28 are located directly after the second spraying unit 21 in a supporting frame 29 attached to the underside of supporting plate 25 and the bristles thereof are designed to extend though corresponding openings 32 in the supporting plate 25 so as to provide holding locations for the upstream end of the second portion 26*b* of the cleaning sheet 26. It will be understood that the brushes 28 are not meant to rest against the surface of the wiping roller 2 but are merely meant to hold the second portion 26*b* of the cleaning sheet 26 in place. Brushes 28 are preferred in this embodiment, but other equivalent means can be provided to provide holding support for the upstream end of the second portion 26*b* of the cleaning sheet 26. The advantage of using brushes 28 resides in the fact that the surface of the wiping roller 2 will not be damaged if the bristles thereof happen to come into contact with the wiping roller 2. It will be understood that brushes 28 substantially close the openings 32, wiping solution sprayed by the second spraying unit 24 being allowed to flow back in the tank 1 through holes 33 provided downstream of the location of the brushes 28. The zone of the supporting plate 25 where the brushes 28 are located thus fulfils substantially the same function as zone Z1.

Figure 5:
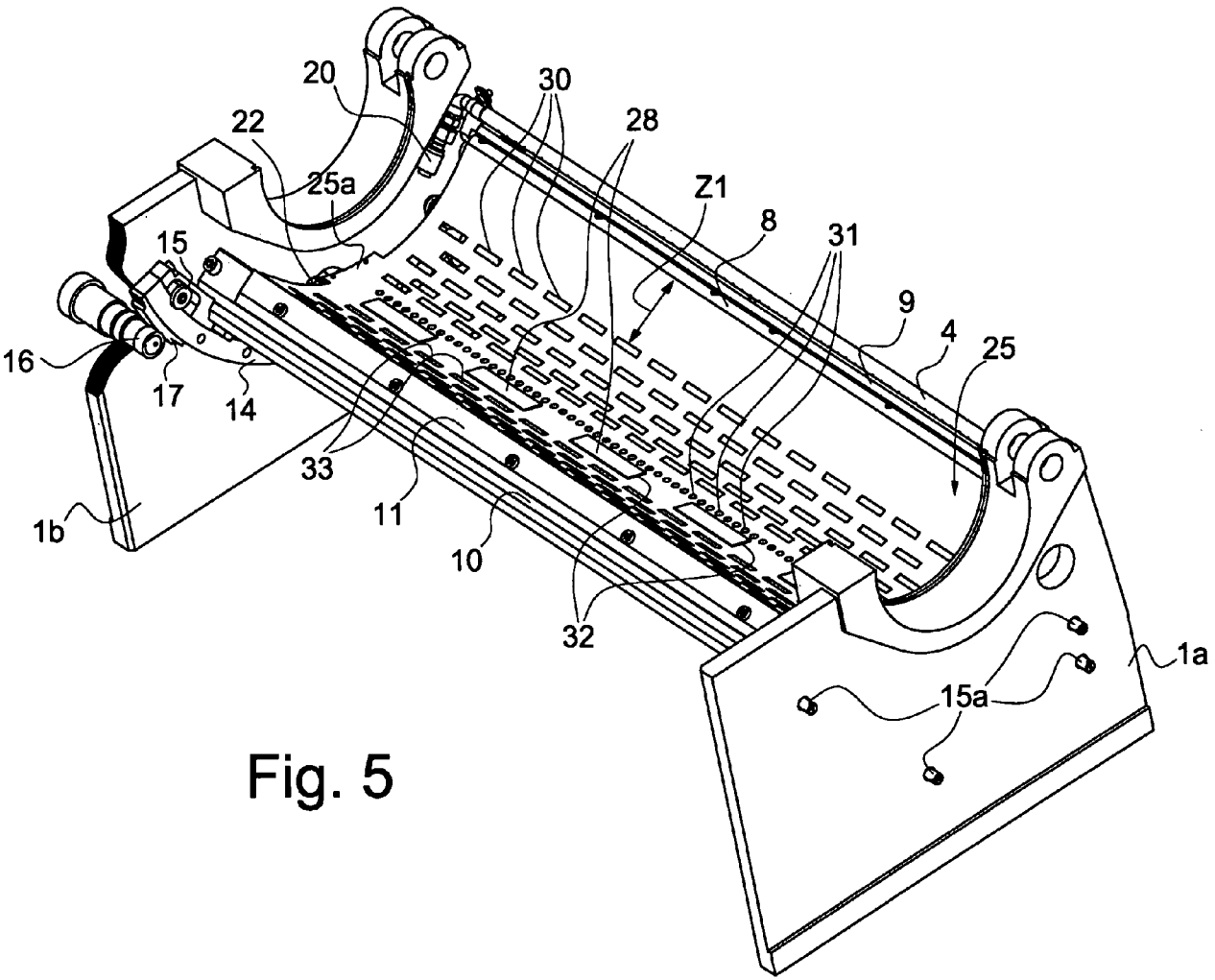
FIG. 5 illustrates a first perspective view of the second embodiment.
Figure 6:
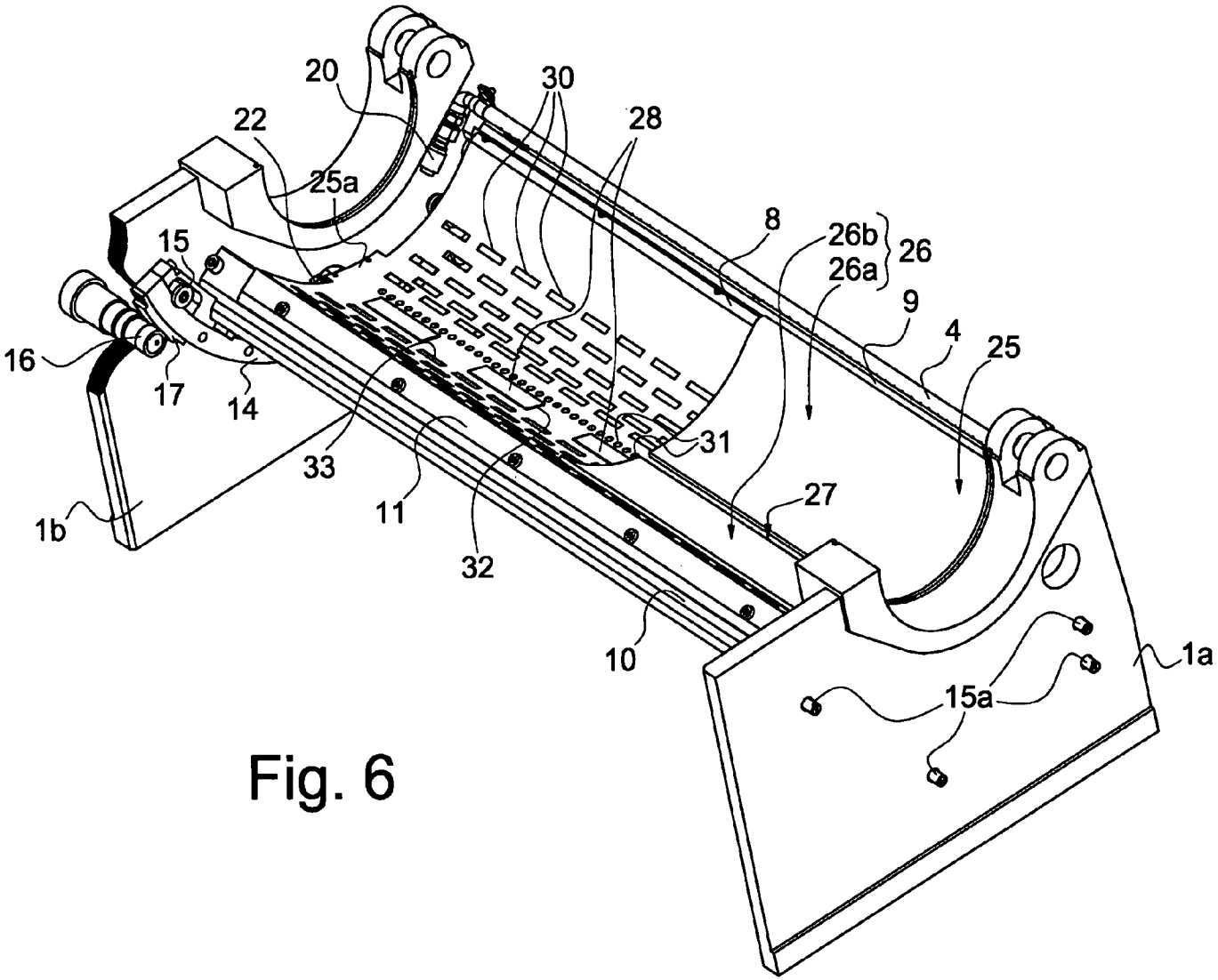
FIG. 6 illustrates second perspective view of the second embodiment.

FIGS. 5 and 6 illustrate a perspective view of the second embodiment of the invention, in which only half of the two portions 26*a*, 26*b* of the cleaning sheet 26 are represented in FIG. 6, while these are omitted in FIG. 5. As one, can see, the main difference between the first embodiment illustrated in FIGS. 2 and 3 and the second embodiment illustrated in FIGS. 5 and 6 resides in the design of the supporting plate 25.

In a first zone Z1 (with respect to the direction of rotation of the wiping roller 2), the plate 25 (similarly to plate 5 of FIGS. 2 and 3) comprises no holes to trap the wiping solution between the surface of the plate 25 and the surface of the wiping roller 2, thus maximizing the cleaning efficiency of the wiping solution. Then, the plate 25 comprises a series of holes 30 arranged in an array. These holes 30 correspond to holes 5' of the first embodiment and allow the wiping solution to flow back into the tank 1.

Then, following the first series of hole 30, the plate 25 comprises a row of spray holes 31, as already mentioned, which are present to allow the spraying of wiping solution into the free zone 27 (see FIG. 4) by the second spraying unit 24.

After this row of spray holes 31, the plate 25 comprises a row of holes 32 which are dimensioned in correspondence to the size of the brushes 28 so as to enable the bristles thereof to extend through the supporting plate 25 into the second portion 26*b* of the cleaning sheet 26.

Finally, the supporting plate 25 comprises another series of holes 33 arranged in an array, like the first series of holes 30 and allowing the sprayed wiping solution to flow back into the tank 1 through the supporting plate 25 during the wiping operation.

Figure 7:
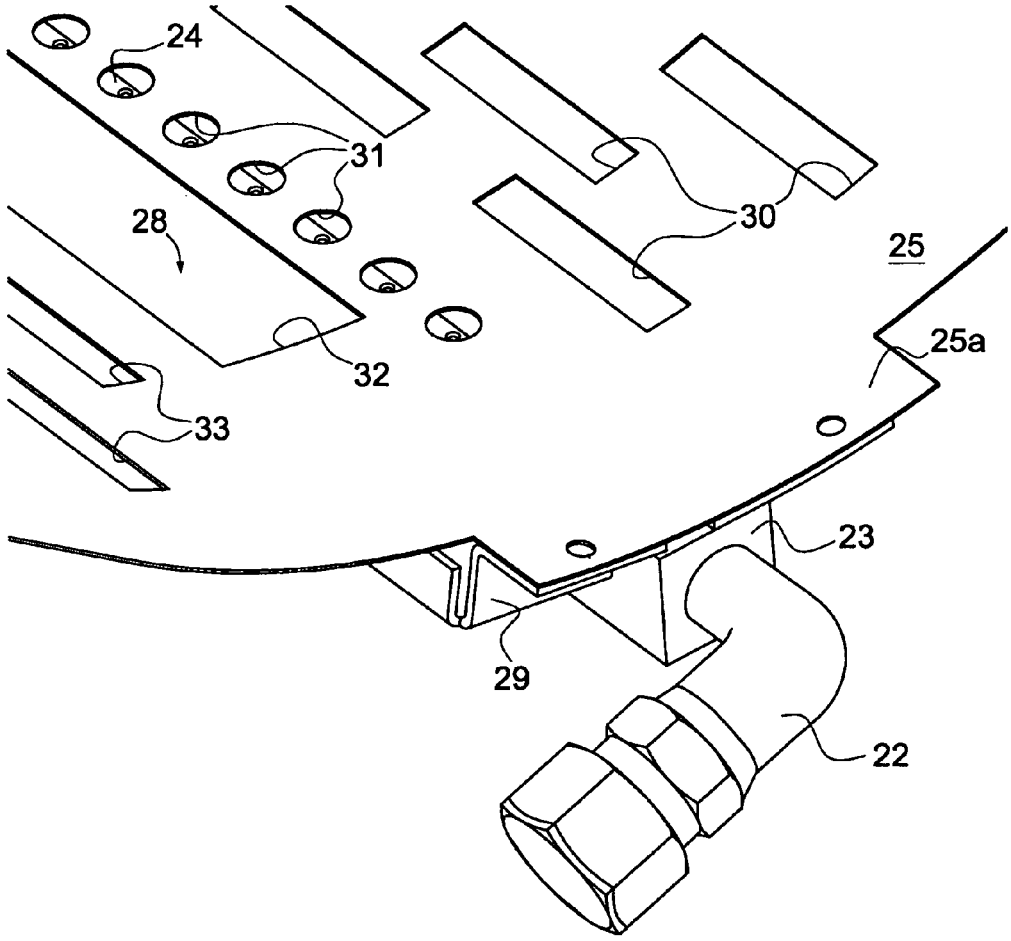
FIG. 7 illustrates a detailed perspective view of the second embodiment.

FIG. 7 is a more detailed perspective view showing the location where the second spraying unit 24 and brush arrangement 28, 29 is fixed to the supporting plate. The rail 23 holding the second spraying unit 24 as well as the support frame 29 holding the brushes 28 are fixed on both sides of the supporting plate 25 (only one side being shown in FIG. 7). To this end, the supporting plate 25 is provided with mounting portions 25*a* (also shown in FIGS. 5 and 6) where the rail 23 and support frame 29 can be secured to the supporting plate 25, for instance by means of screws. These mounting portions 25*a* are located in such a way that they do not directly face the cleaning sheet 26 and the surface of the wiping roller 2. Rather, these mounting portions 25*a* are located in offset positions with respect to both sides of the cleaning sheet 26 and of the wiping roller 2.

Figure 8A:
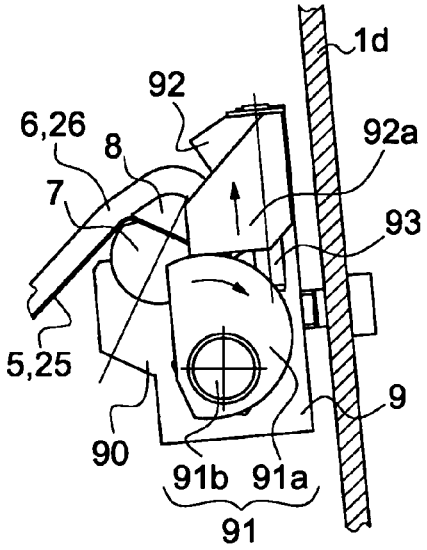
FIGS. 8*a* and 8*b* illustrated detailed side views of the clamping mechanism of the first and second embodiments located at the upstream end of the wiping system.
Figure 8B:
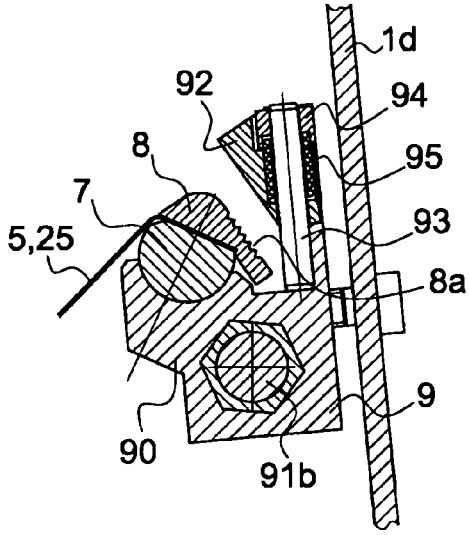

FIGS. 8*a* and 8*b* are side views showing in greater detail the clamping mechanism 9 for holding the upstream end of the cleaning sheet 6 of the first embodiment or of the first portion 26*a* of the cleaning sheet 26 of the second embodiment. As already mentioned, the upstream end of the supporting plate 5, is clamped between lower bar 7 and upper bar 8, while the upstream end of the cleaning sheet 6, 26 is clamped against the upper bar 8 by the clamping mechanism 9. This clamping mechanism 9 is mounted on side wall 1*d* of the tank 1 and comprises a body 90 supporting the lower bar 7 and upper bar 8. A movable clamping member 92 is mounted on body 90 so as to clamp the upstream end of the cleaning sheet 6, 26 against the upper side of the upper bar 8, which upper side is preferably provided with a grooved profile 8*a* to improve the clamping efficiency.

The movable clamping member 92 is mounted on pins 93 which are firmly secured at their upper end to a member 94 which is fixed to the body 90. Spring members 95 are interposed between member 94 and movable clamping member 92 so as to be compressed therebetween when movable clamping member 92 is pushed upwards (as shown in FIGS. 8*a* and 8*b*).

The upstream end of the cleaning sheet 6, 26 is freed by pushing the movable clamping member 92 upwards using a cam mechanism 91 that is rotated clockwise to interact with a corresponding portion 92*a* of the movable clamping member 92. The cam mechanism 91 basically comprises a cam 91*a* cooperating with the portion 92*a* of the movable clamping member 92 that is mounted on a rotatable shaft 91*b* supported by body 90. It will be understood that cam 91*a* and portion 92*a* are provided on both sides of the clamping mechanism 9. Rotation of the cam mechanism 91 can be effected manually or semi-automatically. Once the cam mechanism 91 is rotated back in its neutral position (as shown in FIGS. 1 and 4), the movable clamping member 92 is pushed back downwards under the action of the compressed spring members 95 to clamp the upstream end of the cleaning sheet 6, 26.

Figure 9:
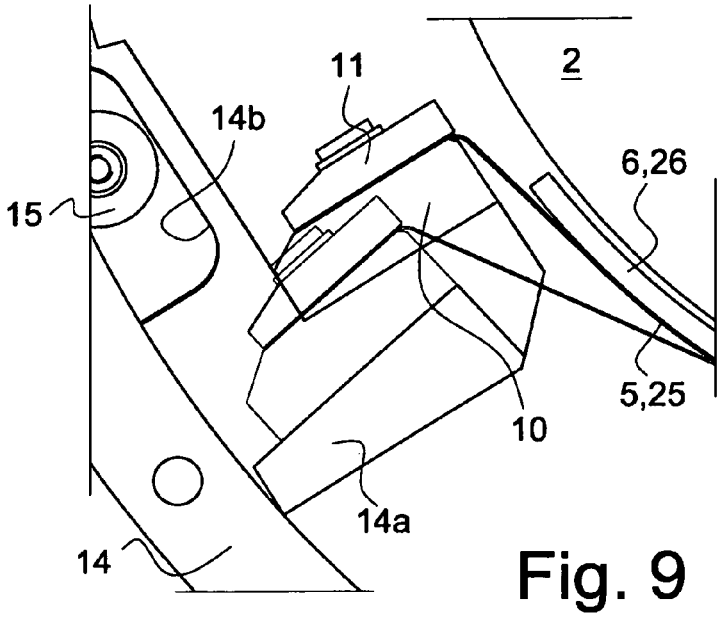
FIG. 9 illustrate a detailed side view of the clamping mechanism of the first and second embodiments located at the downstream end of the wiping system.

FIG. 9 is a schematic drawing illustrating a further possibility of adjustment of the supporting plate 5, 25 with respect to the wiping roller 2. Two mounting positions are provided at the downstream end of the supporting plate 5, 25 where the base member 10 and cover member 11 are provided. In the first position shown in thick continuous lines in FIG. 9, the base member 10 is fixed in an upper location with respect to the curved rail 14, thereby increasing the contacting surface between the supporting plate 5, 25 and the wiping roller 2. In the second position shown in thin continuous lines in FIG. 9, the base member 10 is fixed in a lower location, thereby decreasing the contacting surface between the supporting plate 5, 25 and the wiping roller 2 as compared to the upper location. The modification shown in FIG. 9 enables to adjust the position of the supporting plate 5, 25 with respect to the wiping roller 2 (and as a consequence the pressure as well) without adjusting the position of the curved rails 14, which adjustment is still possible using the toothed wheel and rack arrangement 16, 17 mentioned hereinabove.

One of the main advantages of the invention resides in the combination of the supporting function of the plate and the softness of the cleaning sheet which avoids a direct contact of the supporting plate with the surface of the wiping roller and therefore extensive wear of the surface thereof. Indeed, as mentioned in the preamble, the prior art metal plates are usually made of hardened material which, logically, has a stronger wear effect on the surface of the wiping roller. Also, the wiped ink does not gradually accumulate in the cleaning sheet since clean wiping solution is sprayed against the surface of the roller. In addition, since the holes in the supporting plate are relatively larger than the tiny holes disclosed in the prior art, one also avoids a blocking of said holes by ink residues and particles which will have an effect on the efficiency of the whole system. Furthermore, the spraying hoses mentioned above are provided with relatively wide spraying holes which are less prone to obstruction and clogging.

It will be understood that the embodiments described above are given as non-limiting examples and that various modifications and/or improvements obvious to the person skilled in the art are possible without departing from the scope of the annexed claims.

The number of brushes may be increased or decreased depending for example on the size of the wiping roller. Only one row of brushes is shown in the second embodiment but more than one row could be used. Further, as mentioned, other holding means might be provided or these can be completely omitted provided the second portion of the cleaning sheet is properly held in place by the combination of pressure and of the holding effect of the holes provided in the supporting plate.

The holes in the supporting plates are represented with a rectangular shape, but these can be dimensioned and shaped in any other way, for instance as round or elongated holes.

The invention claimed is:

1. Ink wiping system for an intaglio printing machine comprising a wiping tank, a wiping roller rotatably supported in the wiping tank and having a circumferential surface positioned for rolling contact with at least one printing plate of the intaglio printing machine and cleaning means for cleaning the surface of the wiping roller, said cleaning means comprising at least a first spray unit for spraying clean wiping solution against the surface of the wiping roller and a drying blade placed downstream of said first spray unit with respect to a direction of rotation of said wiping roller for removing wiping solution residues from the surface of the wiping roller, wherein said cleaning means further comprise a cleaning assembly placed between said first spray unit and said drying blade, said cleaning assembly including at least one supporting plate with a series of holes and holding means for holding said supporting plate, said supporting plate being conformed to extend parallel to a part of the circumferential surface of the wiping roller without touching said wiping roller, said cleaning assembly further comprising at least a cleaning sheet made of porous material placed on said supporting plate and in contact with the surface of said wiping roller for removing ink therefrom, wherein said first spray unit is disposed before an upstream end of said cleaning assembly with respect to the direction of rotation of the wiping roller in such a way as to spray clean wiping solution directly between the surface of the wiping roller and said upstream end of the cleaning assembly, and wherein a first portion of said supporting plate directly following the location of said first spray unit is free of any holes so as to constrain the wiping solution sprayed by said first spray unit between the surface of the wiping roller and the surface of the supporting plate.

2. Ink wiping system as defined in claim 1, wherein said supporting plate is a metal plate.

3. Ink wiping system as defined in claim 1, wherein said holes in the supporting plate are shaped and dimensioned so as to hold said cleaning sheet in place on said supporting plate.

4. Ink wiping system as defined in claim 3, wherein said holes are shaped as elongated apertures extending perpendicularly to the direction of rotation of the wiping roller.

5. Ink wiping system as defined in claim 1, wherein means are provided to secure an upstream end of said cleaning sheet with respect to the direction of rotation of the wiping roller.

6. Ink wiping system as defined in claim 5, wherein said cleaning sheet is secured only at said upstream end.

7. Ink wiping system as defined in claim 5, wherein said upstream end of the cleaning sheet is held by means of a releasable clamping mechanism.

8. Ink wiping system as defined in claim 1, wherein said cleaning means further comprise a second spray unit placed downstream of said first spray unit with respect to the direction of rotation of the wiping roller for spraying clean wiping solution against the surface of said wiping roller.

9. Ink wiping system as defined in claim 8, wherein said second spray unit is fixedly secured to said supporting plate.

10. Ink wiping system as defined in claim 1 further comprising an additional blade placed downstream of said cleaning assembly and upstream of said drying blade with respect to the direction of rotation of the wiping roller for removing ink residues from the surface of the wiping roller.

11. Ink wiping system as defined in claim 10, wherein said additional blade is made of or coated with a synthetic material.

12. Ink wiping system as defined in claim 11, wherein said additional blade is made of plastic.

13. Ink wiping system as defined in claim 11, wherein said additional blade is coated with polytetrafluoroethylene (PTFE).

14. Ink wiping system as defined in claim 1, wherein the position of a downstream end of said supporting plate is adjustable so as to vary the contact surface of the cleaning assembly with the wiping roller.

15. Ink wiping system as defined in claim 1 further comprising means for adjusting the pressure exerted by said cleaning assembly on the surface of said wiping roller.

16. Ink wiping system as defined in claim 1 wherein said cleaning sheet contacts the surface of said wiping roller over a sector of at least 70°.

17. Ink wiping system as defined in claim 1, wherein said at least first spray unit is configured as a perforated hose extending substantially parallel to the axis of rotation of the wiping roller and having spraying apertures exhibiting a diameter of approximately one square millimeters or more.

18. Ink wiping system as defined in claim 1 wherein said cleaning sheet is made of a material composed of porous non-woven synthetic fibers.

19. Ink wiping system as defined in claim 1 wherein said cleaning sheet has a thickness ranging from a couple of millimeters to a couple tens of millimeters.

20. Ink wiping system as defined in claim 19, wherein said cleaning sheet has a thickness between 5 and 20 millimeters.

21. Intaglio printing machine comprising an ink wiping system as defined in claim 1.

22. Ink wiping system for an intaglio printing machine comprising a wiping tank, a wiping roller rotatably supported in the wiping tank and having a circumferential surface positioned for rolling contact with at least one printing plate of the intaglio printing machine and cleaning means for cleaning the surface of the wiping roller, said cleaning means comprising at least a first spray unit for spraying clean wiping solution against the surface of the wiping roller and a drying blade placed downstream of said first spray unit with respect to a direction of rotation of said wiping roller for removing wiping solution residues from the surface of the wiping roller, wherein said cleaning means further comprise a cleaning assembly placed between said first spray unit and said drying blade, said cleaning assembly including at least one supporting plate with a series of holes and holding means for holding said supporting plate, said supporting plate being conformed to extend parallel to a part of the circumferential surface of the wiping roller without touching said wiping roller, said cleaning assembly further comprising at least a cleaning sheet made of porous material placed on said supporting plate and in contact with the surface of said wiping roller for removing ink therefrom, wherein said first spray unit is disposed before an upstream end of said cleaning assembly with respect to the direction of rotation of the wiping roller in such a way as to spray clean wiping solution directly between the surface of the wiping roller and said upstream end of the cleaning assembly, wherein means are provided to secure an upstream end of said cleaning sheet with respect to the direction of rotation of the wiping roller, wherein said upstream end of the cleaning sheet is held by means of a releasable clamping mechanism, wherein an upstream end of said supporting plate is also held by said clamping mechanism and wherein said clamping mechanism is adapted to allow release of the cleaning sheet and exchange thereof without freeing the supporting plate which is maintained in clamped position.

23. Intaglio printing machine comprising an ink wiping system as defined in claim 22.

24. Ink wiping system for an intaglio printing machine comprising a wiping tank, a wiping roller rotatably supported in the wiping tank and having a circumferential surface positioned for rolling contact with at least one printing plate of the intaglio printing machine and cleaning means for cleaning the surface of the wiping roller, said cleaning means comprising at least a first spray unit for spraying clean wiping solution against the surface of the wiping roller and a drying blade placed downstream of said first spray unit with respect to a direction of rotation of said wiping roller for removing wiping solution residues from the surface of the wiping roller, wherein said cleaning means further comprise a cleaning assembly placed between said first spray unit and said drying blade, said cleaning assembly including at least one supporting plate with a series of holes and holding means for holding said supporting plate, said supporting plate being conformed to extend parallel to a part of the circumferential surface of the wiping roller without touching said wiping roller, said cleaning assembly further comprising at least a cleaning sheet made of porous material placed on said supporting plate and in contact with the surface of said wiping roller for removing ink therefrom, wherein said first spray unit is disposed before an upstream end of said cleaning assembly with respect to the direction of rotation of the wiping roller in such a way as to spray clean wiping solution directly between the surface of the wiping roller and said upstream end of the cleaning assembly, and wherein said cleaning sheet is subdivided into at least two successive cleaning sheet portions disposed one after the other on said supporting plate and with a free zone in-between.

25. Intaglio printing machine comprising an ink wiping system as defined in claim 24.

26. Ink wiping system for an intaglio printing machine comprising a wiping tank, a wiping roller rotatably supported in the wiping tank and having a circumferential surface positioned for rolling contact with at least one printing plate of the intaglio printing machine and cleaning means for cleaning the surface of the wiping roller, said cleaning means comprising at least a first spray unit for spraying clean wiping solution against the surface of the wiping roller and a drying blade placed downstream of said first spray unit with respect to a direction of rotation of said wiping roller for removing wiping solution residues from the surface of the wiping roller, wherein said cleaning means further comprise a cleaning assembly placed between said first spray unit and said drying blade, said cleaning assembly including at least one supporting plate with a series of holes and holding means for holding said supporting plate, said supporting plate being conformed to extend parallel to a part of the circumferential surface of the wiping roller without touching said wiping roller, said cleaning assembly further comprising at least a cleaning sheet made of porous material placed on said supporting plate and in contact with the surface of said wiping roller for removing ink therefrom, wherein said first spray unit is disposed before an upstream end of said cleaning assembly with respect to the direction of rotation of the wiping roller in such a way as to spray clean wiping solution directly between the surface of the wiping roller and said upstream end of the cleaning assembly, wherein said cleaning means further comprise a second spray unit placed downstream of said first spray unit with respect to the direction of rotation of the wiping roller for spraying clean wiping solution against the surface of said wiping roller, wherein said cleaning sheet is subdivided into at least two successive cleaning sheet portions disposed one after the other on said supporting plate and with a free zone in-between and wherein said second spray unit sprays clean wiping solution through said free zone.

27. Intaglio printing machine comprising an ink wiping system as defined in claim 26.

28. Ink wiping system for an intaglio printing machine comprising a wiping tank, a wiping roller rotatably supported in the wiping tank and having a circumferential surface positioned for rolling contact with at least one printing plate of the intaglio printing machine and cleaning means for cleaning the surface of the wiping roller, said cleaning means comprising at least a first spray unit for spraying clean wiping solution against the surface of the wiping roller and a drying blade placed downstream of said first spray unit with respect to a direction of rotation of said wiping roller for removing wiping solution residues from the surface of the wiping roller, wherein said cleaning means further comprise a cleaning assembly placed between said first spray unit and said drying blade, said cleaning assembly including at least one supporting plate with a series of holes and holding means for holding said supporting plate, said supporting plate being conformed to extend parallel to a part of the circumferential surface of the wiping roller without touching said wiping roller, said cleaning assembly further comprising at least a cleaning sheet made of porous material placed on said supporting plate and in contact with the surface of said wiping roller for removing ink therefrom, wherein said first spray unit is disposed before an upstream end of said cleaning assembly with respect to the direction of rotation of the wiping roller in such a way as to spray clean wiping solution directly between the surface of the wiping roller and said upstream end of the cleaning assembly, and wherein at least one brush is disposed on the other side of the supporting plate with respect to the cleaning sheet, said brush comprising bristles extending through holes of said supporting plate into said cleaning sheet.

29. Intaglio printing machine comprising an ink wiping system as defined in claim 28.

* * * * *